US006053623A

United States Patent [19]

Jones et al.

[11] Patent Number: 6,053,623

[45] Date of Patent: Apr. 25, 2000

[54] WATERPROOF LIGHT WITH MULTI-FACETED REFLECTOR IN A FLEXIBLE ENCLOSURE

[75] Inventors: Dale G. Jones; Barbara L. Marcum, both of San Luis Obispo, Calif.

[73] Assignee: New Option Lighting, LLC, San Luis Obispo, Calif.

[21] Appl. No.: 09/259,833

[22] Filed: Mar. 1, 1999

Related U.S. Application Data

[60] Provisional application No. 60/076,940, Mar. 3, 1998.

[51] Int. Cl.[7] ..... F21V 7/00

[52] U.S. Cl. ..... 362/310; 362/267; 362/348; 362/158; 362/263; 362/345; 362/327; 362/296; 362/189; 362/186

[58] Field of Search ..... 362/267, 310, 362/348, 158, 263, 345, 327, 296, 189, 186

[56] References Cited

U.S. PATENT DOCUMENTS

| | | | |
|---|---|---|---|
| 1,394,319 | 10/1921 | McNeal | 362/348 |
| 4,081,667 | 3/1978 | Lewin et al. | 362/348 |
| 4,996,635 | 2/1991 | Olsson et al. | 362/158 |
| 5,386,356 | 1/1995 | Davis, Jr. et al. | 362/267 |

*Primary Examiner*—Sandra O'Shea
*Assistant Examiner*—Ronald E. DelGizzi
*Attorney, Agent, or Firm*—Christie, Parker & Hale, LLP

[57] ABSTRACT

A light assembly for providing a directed beam of light. The light assembly includes a specially configured lamp-reflector assembly which incorporates a high output lamp. The lamp-reflector assembly also incorporates a multi-faceted reflector for directing the beam of light within a restricted cone angle as it exits the light assembly. The lamp-reflector is housed in a flexible enclosure surrounding a translucent lens at one end and a power cord exiting the opposing end. The flexible enclosure is adapted for waterproof applications.

25 Claims, 6 Drawing Sheets

WATERPROOF LIGHT WITH MULTI-FACETED REFLECTOR IN A FLEXIBLE ENCLOSURE

CROSS-REFERENCE TO RELATED APPLICATION

This application claims priority from provisional application Ser. No. 60/076,940 filed Mar. 3, 1998, which is incorporated herein in its entirety by this reference.

FIELD OF THE INVENTION

The present invention relates to electrically powered light systems for producing directed beams of output light. More particularly, the present invention relates to a light assembly for producing a directed beam of a reflected output light from a low wattage light source and reflector assembly.

BACKGROUND OF THE INVENTION

Lamp assemblies utilizing tungsten filament incandescent lamps are relatively inefficient. In fact, a conventional 40 to 100 watt light bulb utilizing a tungsten filament provides only about 4% to 6% visible light based on the used electric power. The remainder of this used electrical power is mostly converted to heat. This generation of heat can result in dangerously high temperatures. For example, the temperature of many typical frosted glass enclosures for conventional incandescent lamps can easily reach 200° F. to 250° F.

As a conventional incandescent lamp operates, the generated heat causes the tungsten atoms to evaporate from the filament, resulting in it becoming thinner. This evaporation of tungsten may also result in dark deposits of metallic tungsten on the inside of the glass enclosure. As the filament becomes thinner, it eventually breaks. The lifetime of a conventional incandescent light bulb is roughly 700 hours.

Alternatively, tungsten halogen lamps contain iodine, bromine, or chlorine gases or mixtures thereof. These lamps can operate at higher filament temperatures than conventional tungsten lamps because the evaporated tungsten atoms combine with the contained halogen gases, circulate within the lamp, and re-deposit on the filament. The lifetime of tungsten halogen lamps is thereby increased considerably relative to conventional incandescent lamps. In addition, the higher filament temperatures produce whiter, brighter output light at higher color temperatures. Tungsten halogen lamps also operate more efficiently than incandescent. Typically tungsten halogen lamps operate at about 7% to 9% efficiency. However, due to higher operating temperatures, fused quartz glass is required for the enclosure. These glass enclosures must be able to withstand temperatures of approximately 500° F. to 700° F. Also, there is a hazard of exposure to halogen gases if the fused quartz glass enclosure breaks. For cost reasons and to insure high operating temperatures which enable efficient circulation of tungsten-halogen within the enclosure, tungsten halogen lamp enclosures are purposely made small. For example, high wattage tungsten halogen lamps have fused quartz enclosures shaped like a pencil around a linear filament.

A third type of lamp which has been recently developed is a miniature xenon lamp. These lamps operate at lower filament temperatures and can therefore utilize conventional glass enclosures. Xenon flash tubes (for cameras) and xenon strobe lights (for timing lights on reciprocating engines, etc.) have been used for decades in applications where very high light intensity and very white light output is required. The newly developed miniature xenon lamp efficiently produces output light in the visible spectrum from noble gas xenon atoms excited by the tungsten filament inside the lamp. Activated xenon atoms produce an even whiter, brighter, higher color temperature light than tungsten halogen lamps. Xenon lamps also operate at a higher efficiency than tungsten halogen, typically at 10% to 12% efficiency. Compared with tungsten halogen, the xenon lamp also produces much less ultraviolet light component, where such ultraviolet light is highly undesirable. In fact, the spectral emission characteristics of activated xenon atoms show that only 4% of the output light is in the ultraviolet wavelengths below 0.4 microns, 71% is in the visible spectrum from 0.4 to 0.7 microns, and 25% is in the infrared wavelengths above 0.7 microns. Reduced filament temperatures in the xenon lamp, combined with the presence of the safer noble gas xenon, allows the tungsten filament in the xenon lamp to operate for significantly longer times, than even the tungsten halogen lamps.

Different types of low wattage lamps are compared in the following table:

| Characteristic | Incandescent | Tungsten Halogen | Xenon |
|---|---|---|---|
| Typical Wattage Rating | 40–100 W | 10–50 W | 5–35 W |
| Typical Filament Lifetime | 700 hrs | 1500 hrs | 10,000 hrs |
| Type of Filament | tungsten | tungsten | tungsten |
| Light-to-Electricity Efficiency | 4–6% | 7–9% | 10–12% |
| Potential Halogen Gas Hazard | no | yes | no |
| Type of Enclosure | glass | fused quartz | glass |
| Enclosure Surface Temperature | 225° F. | 550° F. | 475° F. |
| Typical Power Supply Voltage | 120 volts | 12 volts | 12 volts |
| Typical Color Temperature | 2400 K | 2700 K | 3000 K |

Low voltage (typically 12 volt) tungsten halogen lamps are so small and so bright that small glass reflectors with dichroic reflective coatings and multiple facets have become widely used to provide a directed beam of output light. These glass reflectors are called MR-11 (in 12 volt ratings from 5 watts to 35 watts with G4 bi-pin lamps) and the MR-16 (in 12 volt ratings from 10 watts to 100 watts with G5.3 and G6.35 bi-pin lamps). The MR-11 reflector is only 35 mm in diameter and 27 mm long, with 1.0 mm diameter by 6.0 mm long connection pins spaced 4.0 mm apart. The MR-16 reflector is somewhat larger, but still only 50 mm in diameter and 38 mm long, with 1.5 mm diameter by 7.0 mm long connection pins spaced 5.3 or 6.3 mm apart. Since tungsten halogen lamps are significantly brighter than incandescent lamps, less wattage is needed for the same illumination, and the extremely small size is a great advantage in locating these types of light fixtures where incandescent lamps would not physically or aesthetically fit.

Many types of directed-beam lighting systems using tungsten halogen lamps have come into wide use. Track-mounted systems (i.e. located on ceilings) are very popular because individual lights can be directed where better illumination is desired. None of these types of track-mounted directed-beam lighting systems using tungsten halogen lamps are waterproof. None of them can be used where water might come into contact with the lighting system.

Although small in size and high in brightness, one problem with tungsten halogen lamps is the relatively high temperatures at which tungsten halogen lamps operate. For example, with a 12 volt, 10 watt tungsten halogen lamp in an MR-11 glass reflector, the temperature of the outer surface of the MR-11 reflector itself operates between 350° F. and 400° F., which is much too hot to touch without burning and which can also cause scorching or burning of adjacent materials.

Typically, metal housings are used to enclose these lamp-reflector assemblies. Air cooling slots may be provided to vent some of this excessive heat. Even so, fingers or hands are still easily burned when touching the housing such as when adjusting the direction of the output light beam or when changing the position of a tungsten halogen lamp fixture mounted on a goose neck. Therefore, there is a need for a lamp assembly which can provide a high intensity directed output beam without having a high temperature enclosure.

During the investigation which led to the discovery of this invention, we attempted to develop an enclosure for a lamp-reflector assembly which would be safe to touch and handle, but which would also be waterproof because of the variety of applications for small lighting systems where the waterproof feature would provide distinct advantages over other presently available lighting systems. The investigation started with tests to verify the performance of commercially-available waterproof lighting systems using tungsten halogen lamps.

Initial tests were performed using a 12 volt, 10 watt halogen lamp. This lighting system consists of a solid transparent (Pyrex) test tube, approximately 0.375 inch in diameter, with a rubber stopper through which the electrical connection wires pass to the tungsten halogen lamp itself. During these tests, a hole was burned in a living room carpet due to the very high surface temperature of the Pyrex test tube enclosure. Although the lamp met the waterproof requirement, it suffered from very high and unacceptable temperatures when operated in ambient air. Also, the output light is unshielded and there is not a directed output light beam. A directed output light beam is much more desirable.

Additional tests were also performed using a similar halogen lighting system. In this test, a 12 volt, 20 watt tungsten halogen lamp and MR-11 reflector is contained within a solid cylindrical plastic enclosure, approximately 2.2 inches in diameter by 2.2 inches long. The enclosure has a screw-on (¼ turn) removable cover that contains a translucent polycarbonate plastic lens, which can be exchanged to change the color of the output light. When the cover is screwed on, the plastic lens is forced against a square thermoplastic gasket that is supposed to provide a water seal. However, changing the plastic lenses was difficult by hand and even with the aid of pliers was not easy. Changing the color of the output light is not convenient. Unfortunately, after operating the test lamp for some time, the durometer rating of the gasket material became higher, and there was insufficient compression to enable a good water seal. Water leaked into the housing despite attempts to smooth the injection molding imperfections in the plastic sealing surfaces. Several tungsten halogen lamps then rapidly failed due to either thermal shock of the fused quartz lamp enclosure or electrolytic corrosion damage of the 12 volt terminal pins.

These tests, along with an investigation of several other types of underwater lighting systems having similar problems, show that there is a need for an improved low-wattage lighting system for producing a directed beam. Such a lighting system would be capable of using tungsten halogen lamps, xenon lamps or other high-output lamps in small lamp-reflector assemblies to provide output light in a directed beam. Such a lighting system would preferably provide for optionally changeable colors housed in an enclosure which would minimize the risk of burn or fire. There is also a need for such a light assembly which could be operated underwater or at least in wet environments.

SUMMARY OF THE INVENTION

The needs have been satisfied by the light assembly of the present invention. The light assembly is adapted for directing output beam of light and comprises a lamp-reflector assembly housing an electrically powered lamp. The lamp-reflector assembly is housed within a flexible enclosure which extends between a front opening and a rear opening. A translucent lens is supported by and at least partially surrounded by the enclosure. The lens is placed forward of the lamp-reflector assembly and acts as a protective cover while allowing the transmission of the output beam. A power cord is used to power the lamp.

The power cord is passed into the flexible enclosure through the rear opening. Both the front and rear openings are adapted to form a seal about the lens and the power cord respectively. The power cord is connected to a tungsten halogen or alternatively xenon or other high output lamp.

One important aspect of the present invention relates to the configuration of the flexible enclosure. The enclosure is provided with an external wall and an internal wall. The internal wall defines the inner surface which supports the lamp-reflector assembly. Internal fins are incorporated within the enclosure which supports the lamp-reflector assembly and assists in centering it within the enclosure. This centering provides a layer of air between the lamp-reflector assembly and the enclosure and prevents direct transfer of heat from the reflector which minimizes the surface temperature of the enclosure, making the light system safe to touch with the hands and eliminating the risk of burns or fire.

The configuration and flexible material of the flexible enclosure allows adaptability to underwater or wet environment applications without compromising the integrity or lifetime of the lamp. The deeper the lamp assembly is submerged, the tighter the enclosure is compressed and the tighter the enclosure seals around the lens and power cord.

Another important aspect of this invention relates to the use of miniature xenon lamps in MR-11 or MR-16 glass reflectors to provide significant advantages compared with comparable use of tungsten halogen lamps, for example, but not limited to: reduced temperature of lamp-reflector assemblies; whiter, brighter light with fewer ultraviolet light components; significantly longer operating lifetimes; and no risk of exposure to halogen gas.

In one embodiment of the present invention, a small electrically powered light assembly is described having a directed output light beam. The light assembly includes a lamp-reflector assembly housed in an outer flexible enclosure. Waterproof seals which prevent entry of water are formed in part, due to the soft material of the flexible enclosure. These seals are formed where the installed front translucent lens and the installed rear power supply cord are squeezed within the openings or passageways through the walls of the flexible enclosure. The seals are self-energizing and become tighter as water pressure is increased.

One of the waterproof seals is formed between a groove at the inside diameter of the front opening in the enclosure and an outer radial lip around the translucent front lens. The other seal is formed between the rear opening and the compatibly sized outer diameter of the electrical power supply cord.

The translucent front lens has a solid outer peripheral lip which can be pushed by hand into the matching internal round groove inside the front periphery of the flexible enclosure. The translucent front lens is also larger in diameter than the maximum diameter of the lamp-reflector assembly, thereby enabling removal and replacement of the lamp-reflector assembly when the front lens is removed. The translucent front lens can be easily exchanged (using hands and fingers) for an alternative colored or shaped lens to provide a variety of optional colors for the output light beam. The electrical power supply cord can be pushed by hand through the compatibly sized and shaped opening in the rear of the flexible enclosure.

The flexible enclosure also contains three or more internal fins which guide the lamp-reflector assembly toward a centrally located electrical socket connection at the end of the power cord within the enclosure. The fins also provide an insulating air layer for reduced heat transfer from said lamp-reflector assembly to the outer surface of the flexible enclosure.

In addition, means of providing reduced operating temperatures and longer lifetimes may be employed by using xenon lamps in miniature MR-11 or MR-16 sized glass reflectors with dichroic coatings and suitable multiple facets to provide a directed beam of output light, wherein the reflected light is directed into a beam of output light having a total included cone angle of less than about 80°.

The lamp-reflector assembly contains either a tungsten halogen or xenon lamp suitably mounted in a dichroic-coated glass reflector having multiple facets which reflect the output light into a directed beam having a total included cone angle of less than about 80°. The glass reflector is a miniature reflector, either an MR-11 or an MR-16 size.

This invention, together with the additional features and advantages thereof, which was only summarized in the foregoing passages, will become more apparent to those of skill in the art upon reading the description of the preferred embodiments which follows in this specification, taken together with the following drawings.

DETAILED DESCRIPTION OF THE PREFERRED EMBODIMENT

Figure 1:
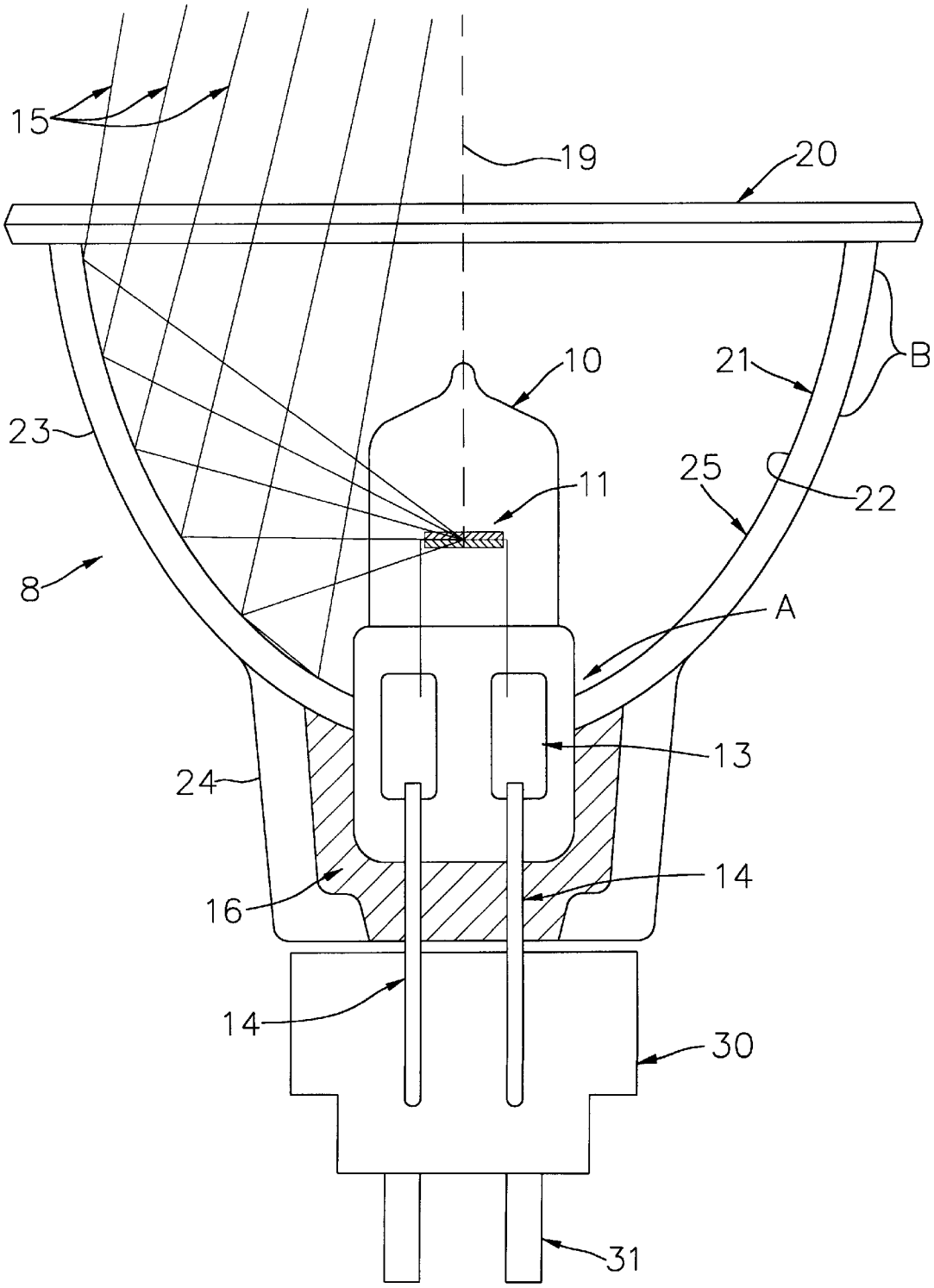
FIG. 1 is a semi-schematic sectional view of a lamp-reflector assembly constructed according to the principles of the present invention and incorporating a conventional tungsten halogen.

Referring to the drawings wherein like reference numerals designate identical or corresponding parts throughout the several views and embodiments, an exemplary embodiment of a lamp-reflector assembly provided according to the principles of the present invention is illustrated in FIG. 1 and identified by reference numeral 8. As shown in the figures, the lamp-reflector 8 includes a lamp enclosure 10 which houses a lamp filament 11. In the embodiment illustrated, the enclosure 10 is constructed of fused quartz, and the filament 11 is a tungsten halogen filament. Electrical connection pins 14 are connected to the filament 11 through conductors 13 which are embedded within the fused quartz material.

As previously described, the space around the tungsten halogen filament 11 contains halogen gases such as iodine, chlorine, bromine, or mixtures thereof to promote the tungsten halogen cycle. This cycle extends the life of the lamp and increases the intensity of the output light.

A reflector 23 supports the lamp 10 and provides a reflective inner surface 21. The reflector illustrated is preferably sized and configured as a conventional MR-11 reflector. However, any similarly configured reflector may be used as will be understood to those of skill in the art. Thus, the reflector 23 has a base 24 which is rectangular in cross-section but may be of any cross-sectional shape. In the MR-11 configuration, the dimensions of the rectangular base 24 are approximately 14 mm by about 9 mm. A small socket, 30 is removably coupled to the connection pins 14. An electrical cord (not shown) is coupled to the socket 30 to provide electrical power to the lamp 10. The power cord preferably includes two electrical cord wires (or three, with a ground) each of which is crimped or otherwise coupled to one of a pair of terminal pins 31 of the socket 30. The terminal pins 31 are preferably spring-type terminal pins. The socket 30 may be made from an insulating material capable of withstanding temperatures associated with those generated by lighting systems.

The lamp-reflector assembly 8 is plugged into socket 30 by inserting the connection pins 14 into enclosed open ends of the metal spring-type terminal pins 31. This connection makes an electrical circuit capable of withstanding high operating temperatures but still capable of being disconnected to replace the lamp-reflector assembly 8 when the lamp 10 burns out or otherwise becomes non-functional. A fixed connection socket may be used in applications where lamp-reflector replacement is not desired or possible.

The tungsten halogen lamp 10 is embedded and fixed within the reflector 23 with a cement 16 to make a single lamp-reflector assembly 8. The assembly 8 may also include a front glass cover 20 which acts as a cover to the parabolic or similarly shaped reflector 23. Preferably, the reflector 23 is made from a glass material such as provided with conventional MR-type reflectors. The assembly 8 is provided with the front glass sealed cover 20 to prevent exposure to halogen gases if the lamp explodes or is broken.

The reflector 23 must be capable of efficiently reflecting the light emanating from the lamp 10. To accomplish this, the reflector 23 must be made from a reflective material or alternatively coated with a reflective coating. Preferably, the inside surface 22 of the reflector 23 is coated with a highly reflective coating 21 which insures that light rays or the light beam 15 is efficiently reflected. One suitable coating includes a silver-colored, dichroic coating 21 which is applied in a thin layer. The dichroic coating may be applied to the inner surface 21 using a vapor deposition process within a vacuum environment as is known to those of skill in the art. The coating may be kept sufficiently thin to reduce costs and, as such, may be less than 10 microns in thickness.

The reflector 23 is configured having a curved internal surface 22, such as a parabolic surface, so as to reflect the light emanating from the lamp 10 and produce a directed output light beam 15 having a total included cone angle of less than 80° (reflected light). This internal or inner surface is provided with facets 25 to increase the efficiency of reflection and to direct the output light beam 15 into desirably wider or narrower total included cone angles. The total included cone angle is an approximation of the angle defining the cone formed by the directed output light beam emanating from a point source. Thus, the lamp 10 is the apex of the cone and may be approximated as a point source. The reflected light beam 15 creates the cone of light. The greater the cone angle, the wider the output light beam 15.

When using the tungsten halogen lamp 10 of the present invention, a conventional off-the-shelf reflector may be used. For example, an MR-11 or MR-16 reflector may be used. Alternatively, a reflector constructed according to the principles of the present invention and described in greater detail below may also be used. The lamp-reflector assembly 8 is then housed in an enclosure (not shown in FIG. 1), as will also be described in greater detail below.

Light rays 15 emanating directly from the filament 11 and exiting the reflector 23 without reflection have not been shown in the figures. These directly emanating light rays (non-reflected light) produce a wider cone angle than those reflected by the lamp-reflector assembly 8. This is because the reflected output light beam 15 is directed more toward the centerline 19 of the lamp-reflector assembly.

Figure 2A:
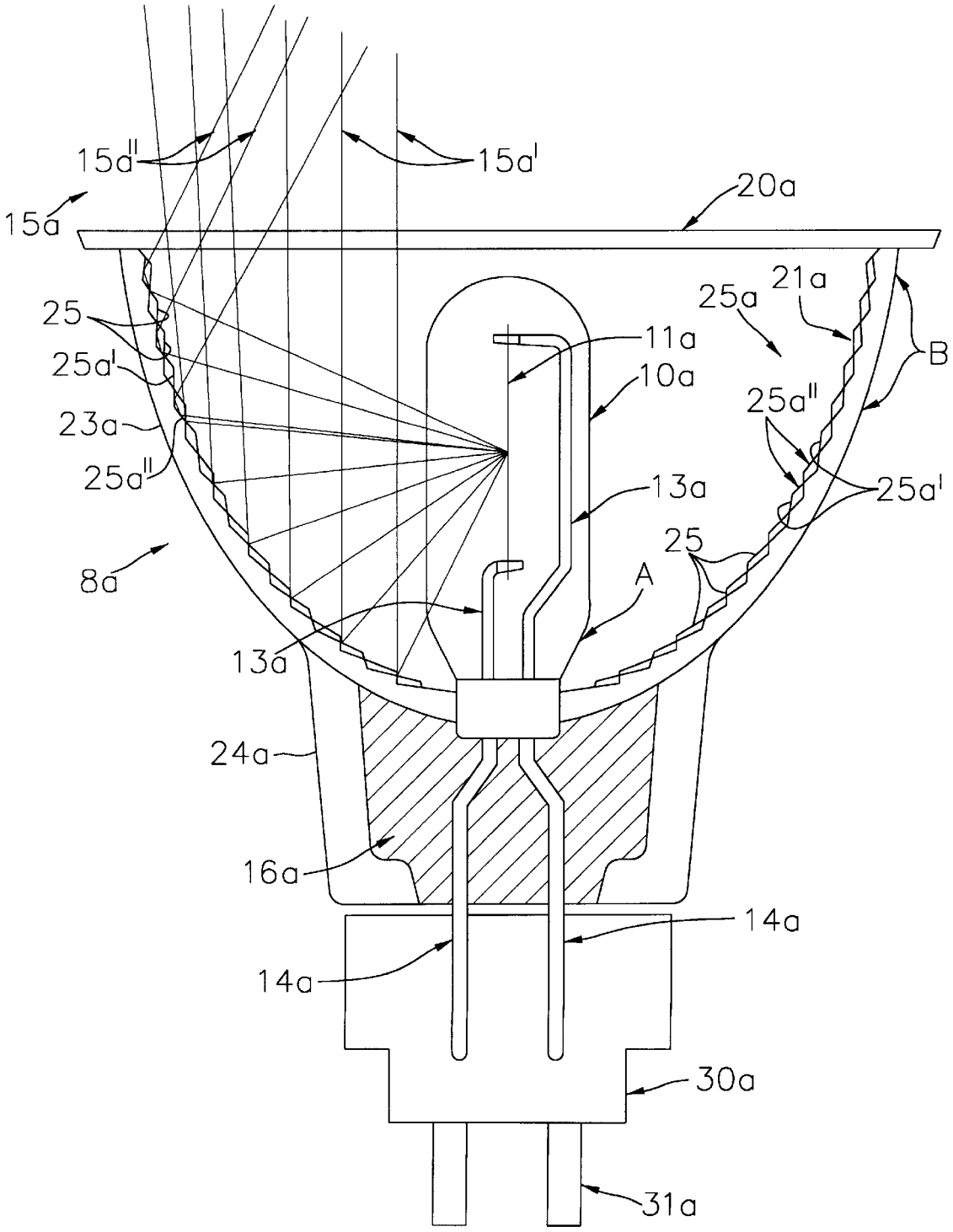
FIG. 2*a* is a semi-schematic sectional view of a lamp-reflector assembly constructed according to the principles of the present invention shown incorporating a xenon lamp and showing the light rays emanating from the center of the filament.
Figure 2B:
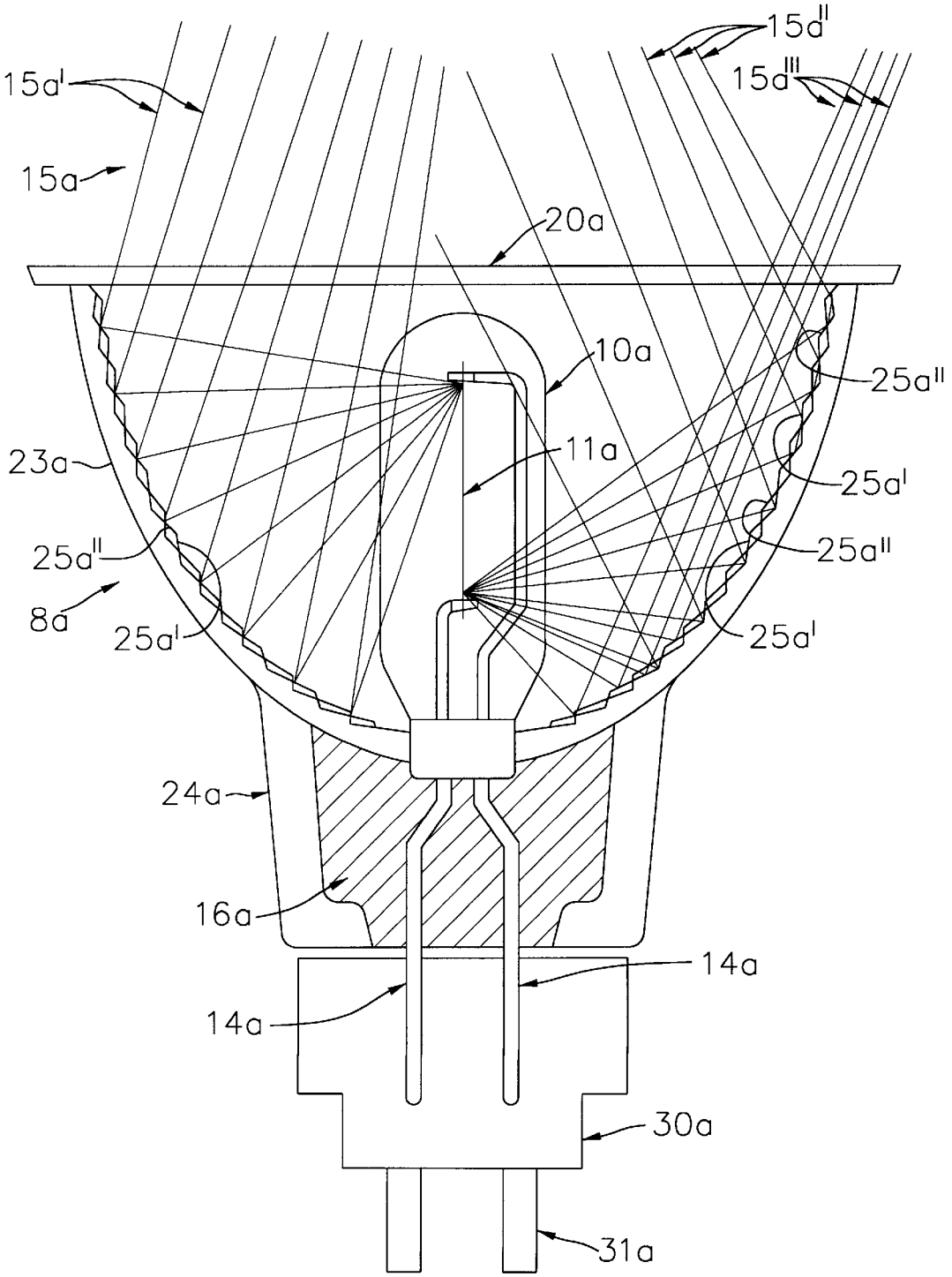
FIG. 2*b* is a semi-schematic sectional view of the lamp-reflector assembly of FIG. 2*a*, showing the light rays emanating from opposing ends of the filament.
Figure 2C:
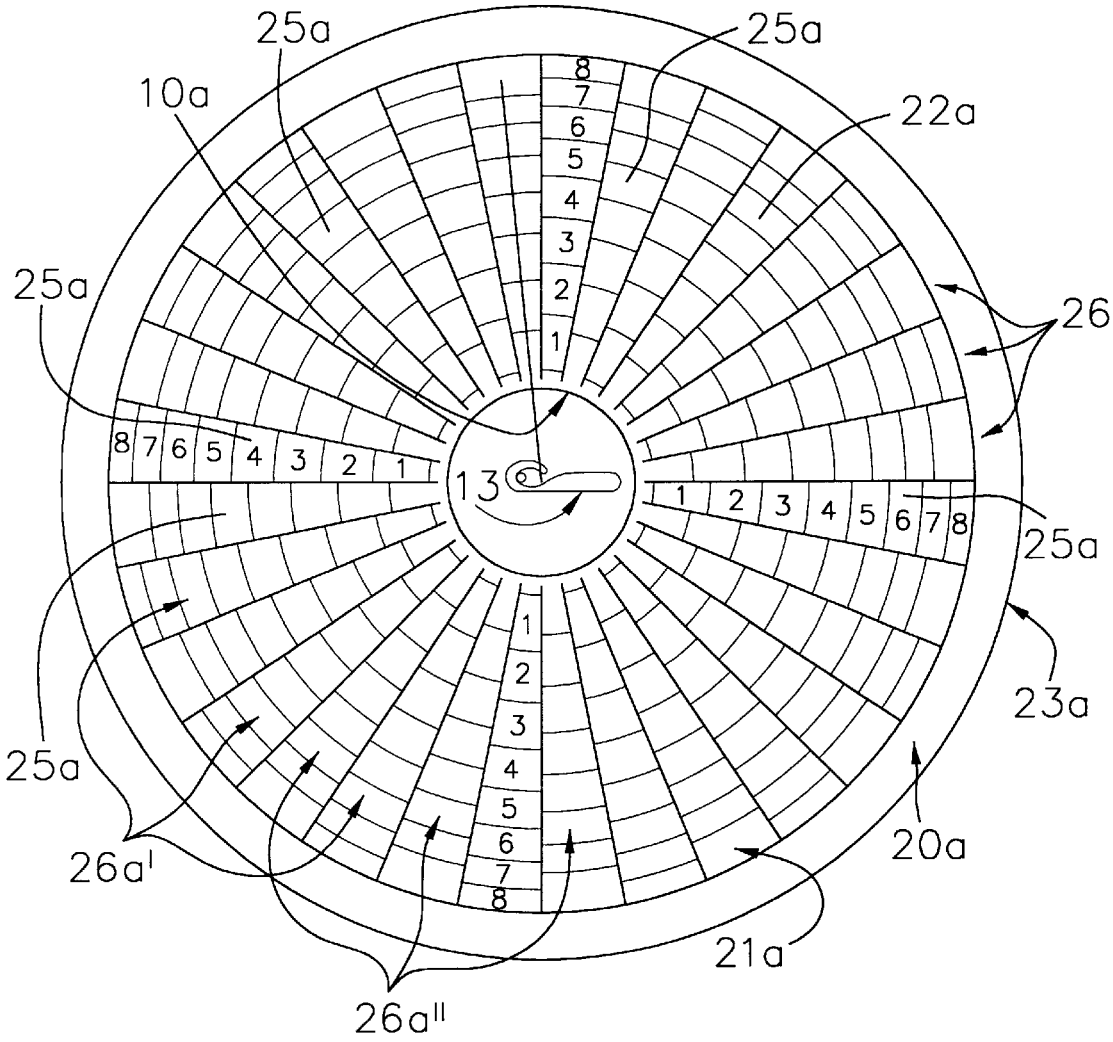
FIG. 2*c* is a semi-schematic top view of the lamp-reflector assembly of FIGS. 2*a* and 2*b*, showing the staggered arrangement of the reflective facets.

Referring now to FIGS. 2*a*, 2*b*, and 2*c*, an alternative embodiment of a lamp-reflector assembly constructed in accordance with the present invention is shown. In this embodiment, like features to those of previous embodiments are designated by like reference numerals, succeeded by the letter "a." Referring now in particular to FIG. 2*a*, a lamp-reflector assembly 8*a* is shown supporting a lamp 10*a*. In this embodiment, the illustrated lamp 10*a* is a xenon lamp which includes an axially aligned tungsten filament 11*a*. In this embodiment, the lamp-reflector assembly 8*a* includes a reflector 23*a* specially adapted for use with lamps having axially aligned filaments.

The lamp 10*a* includes electrical connection pins 14*a* which are embedded within glass material. As previously described, the space around the axial filament 11*a* of the xenon lamp 10*a* contains xenon gas at low pressure which allows the tungsten filament to excite the xenon atoms, thereby producing an even whiter, brighter, higher color temperature light output for the same electrical power input compared with a tungsten halogen lamp. In addition, the noble gas xenon allows the axial tungsten filament 11*a* in the xenon lamp 10*a* to operate at a lower temperature compared with the tungsten halogen lamp filament. This also acts to extend the relative life of the lamp 10*a*.

The base 24*a* of the reflector 23*a* has two connection pins 14*a* which are inserted into two metal spring-type terminal pins 31*a*. The terminal pins 31*a* are installed in a small socket 30*a*. Two electrical power supply cord wires (not shown) are connected by electrically coupling the wires to the terminal pins 31*a* which extend outside of the socket 30*a*. The lamp-reflector assembly 8*a* may then be plugged into the socket 30*a* by inserting the connection pins 14*a* into the enclosed ends of the metal spring-type terminal pins 31*a* thereby making an electrical circuit capable of withstanding high operating temperatures. The connection is capable of being disconnected to replace the lamp-reflector assembly 8*a* when the xenon lamp 10*a* burns out or otherwise becomes non-functional.

As illustrated, the xenon lamp 10*a* is embedded and fixed within a MR-11 sized reflector 23*a* using a cement 16*a*, such as a ceramic cement. This construction makes a single lamp-reflector assembly 8*a*. When using a xenon lamp 10*a*, a front glass cover 20, although shown in the illustrated embodiment, is not required since there is no risk of exposure to halogen gas if the glass envelope explodes or is otherwise broken as would be the case with a tungsten halogen lamp.

The reflector 23*a* is modified from the reflector 23 of FIG. 1 to accommodate an axially aligned filament 11*a* and lamp 10*a*. This reflector 23*a* will be described in greater detail below. Tests were conducted using the xenon lamp 10*a* of FIG. 2*a* mounted in the unmodified reflector 23 as previously described and illustrated in FIG. 1. The result was an output light beam 15*a* having a very wide total included cone angle of more than 120°. In addition, the central axis of the output light beam 15*a* was shadowed, and severe shadowing marks were observed at the outer portions of the very wide output light beam 15*a*. These adverse effects were alleviated by frosting the lamp enclosure 10*a*, thus significantly reducing these observed shadowing effects. This was created by etching the inside of the xenon glass enclosure 10*a* to create a translucent, but not transparent, glass enclosure for the xenon lamp. However, the lamp 10*a* may be frosted using any technique known to those of skill in the art.

Referring in particular to FIGS. 2*a* and 2*b*, only the reflected light rays from the tungsten filament 11*a* are shown. A small portion of the light rays which emanate directly from the filament 11*a* and form a portion of the output beam 15*a*, but are not reflected off the reflector 23*a*, have a wider angle than the reflected light rays. Due to the unique orientation and configuration of the facets 25 provided on the inside surface 22*a* of the reflector 23*a*, the reflected light rays (15*a*' and 15*a*") are directed toward the centerline of the lamp-reflector assembly and have a smaller total included cone angle.

To ensure efficient reflection and directing of the emanating light, the inside surface 22*a* of the reflector 23*a* is coated with a highly reflective material. Preferably, this may be a silver or other reflective-colored, dichroic coating 21*a* as described in the previous embodiment. The reflective coating 21*a* in conjunction with the facets 25 insure that reflected light rays 15*a*' and 15*a*" are directed into an output light beam having a total included angle of less than about 80°.

As mentioned, in this embodiment, the reflector 23*a* is configured to couple with an axially aligned lamp such as the xenon lamp 10*a* illustrated. The reflector 23*a* may be configured along the lines of a conventional MR-type reflector which has been modified. For example, depending on the type and size of the lamp 10*a*, the reflector may be configured along the lines of an MR-11 or MR-16 reflector. However, the reflector 23*a* may be configured and sized according to the principles of the present invention to accommodate any desired lamp.

Faceting 25*a* on the inside surface 21*a* of the reflector 23*a* is configured to direct the reflected light from the xenon lamp 10*a* into an output light beam 15*a* having a total included cone angle of less than about 80°. All of the facets 25*a* are more or less flat, except for manufacturing surface imperfections or distortions caused by discontinuities at the edges of any particular facet. As previously mentioned, the reflector 23*a* is provided with a reflective surface for efficient reflection of the light. Preferably, the inside surface 21*a* (facets 25*a*) is coated with a highly reflective, silver colored, dichroic coating which directs the reflected light rays toward the centerline of the lamp-reflector assembly 8*a* and provides an output light beam 15*a*.

As illustrated in FIG. 2*c*, the reflector 23*a* includes 32 radial lanes 26 of facets 25*a* on the inside surface 21*a*. Preferably, the reflector 23*a* comprises a parabolic shape and each of the radial lanes is of generally the same configuration. However, for the purpose of increasing the strength and durability of the glass material and as is described in greater detail below, the reflector 23*a* is provided with alternating radial lanes 26 of facets 25*a* around the circumference of the reflector to approximate a more uniform average glass thickness. Providing alternating or staggered lanes 26, each with a plurality of individual facets 25*a* also provides the glass reflector 23*a* with increased mechanical strength since this staggers the thinner and thicker sections of each facet 25*a* created during the glass molding process. This is especially important when the reflector 23*a* is heated and cooled by the lamp 10*a*. Staggering the lanes 26 also minimizes the thin sections of the glass.

Preferably, the reflector 23*a* is constructed of a glass, such as a borosilicate-type glass. The glass may be molded using known glass molding techniques, such as conventional glass injection molding. However, the glass reflector 23*a* may also be constructed using any other method or technique known to those of skill in the art, such as casting. Alternatively, the reflector 23*a* may be made from a metal and stamped, such as a stamped aluminum reflector.

As shown in FIGS. 2*a*, 2*b*, and 2*c*, there are a plurality of reflective facets 25*a* defined along each of the radial lanes 26. To enable the glass reflector 23*a* to be manufactured in a molding operation, it is necessary that each of the facets 25*a* open outward toward the output light beam 15*a* direction. A particular facet 25*a* can, however, be nearly parallel with the axis of the output light beam except for a small draft angle as needed to facilitate the glass molding manufacturing process. As shown in FIG. 2*c*, there are at least 32 radial lanes 26 of facets 25*a*. Each radial lane 26 contains at least 6 facets 25*a* opening outward toward the light beam direction and a similar number of facets which are nearly parallel with the axis of the light beam. This creates a stair-stepped configuration of facets 25*a* along the length of each radial lane 26. Each portion of each stair comprises two facets 25*a*. As can be seen in FIGS. 2*a* and 2*b*, the lower or rise portion of each stair defines a lower facet 25*a*', and the upper or step portion of each stair defines an upper facet 25*a*".

As shown in particular in FIG. 2*c*, the radial lanes of facets 26*a*' and 26*a*" alternate such that there are at least 16 radial lanes of type 26*a*' interspersed between at least 16 radial lanes of type 26*a*". As discussed, this staggering configuration of facets provides increased mechanical strength and more uniform average thickness of the glass material. All of the facet surfaces are more or less flat, except for manufacturing surface imperfections or distortions caused by discontinuities at the edges of any particular facet.

Referring back to FIG. 2*a*, the light rays emanating from the center of the axially aligned xenon lamp filament 11*a* impinge on a particular radial lane of facets 26*a* such that the output light rays are reflected into a total included cone angle of less than 60°. As illustrated, there are single-reflection light rays 15*a*' which are reflected from facets 25*a* located at the smaller diameter portion of the reflector 23*a*, and double-reflection light rays 15*a*" which are reflected from facets 25*a* located at the larger diameter portion of the reflector 23*a*. Double reflections occur where the light emanating from the lamp 10*a* strikes two facets 25*a* before leaving the lamp-reflector assembly 8*a*; i.e., the light first strikes an upper or step facet 25*a*" which is then reflected into a lower or rise facet 25*a*' which is then directed out of the reflector 23*a* as the output light beam 15*a*".

In the preferred embodiment, each of the step facets 25*a*" on each radial lane 26 may have a decreasing slope or reflector surface angle as it is located closer to the base 24*a* of the reflector 23*a*. In the preferred embodiment shown, there are 8 "stair treads" or "stair facets" 25*a*. The reflector surface angle of the step facets 25*a*" are as follows:

| | |
|---|---|
| First or most internal facet | 16° |
| 2nd facet | 22° |
| 3rd facet | 28° |
| 4th facet | 34° |
| 5th facet | 39° |
| 6th facet | 43° |
| 7th facet | 47° |
| 8th or outermost facet | 50° |

The angle is measured by defining the vertical axis or direction as 90°, and the horizontal or radial direction as 0°. The lower or rise facets 25*a*' (most vertically oriented facets) are each preferably oriented at approximately 80° to 90°.

In FIG. 2*b*, the light rays emanating from the upper portion of the axially aligned xenon filament 11*a* and reflected off facets 25*a* at the larger diameter portion of the reflector 23*a* are reflected into an axial output light beam 15*a*' similar to the reflected rays from the tungsten halogen lamp as shown in FIG. 1. However, as shown, the light rays 15*a*" and 15*a*'" emanating from the lower portion of the xenon filament 11*a* are reflected into an output light beam (15*a*" and 15*a*'") having a larger total included cone angle than the 15*a*' reflected light rays. The light rays 15*a*" are double reflections and the light rays 15'" are single reflections. Yet the total included cone angle of the reflected light was still less than about 60°. The total reflected light from the xenon lamp 10*a* mounted in the glass reflector 23*a* of the present invention is therefore directed into an output light beam having a total included cone angle of less than about 80°.

The reflector 23*a* may be generally configured as an MR-11 or MR-16-type glass reflector which has been redesigned in accordance with practice of the present invention to accept an axially aligned filament 11*a* and to direct the output light beam from the xenon lamp 10*a* to have a total included cone angle of less than about 80°. Since a portion of the output light from the xenon lamp 10*a* emanates directly from the filament 11*a* without being reflected, a small amount of the output light beam (not illustrated) may be directed at a total included cone angle of greater than 80°. However, this is only a small portion of the total output light beam.

When using an axial-filament xenon lamp 11*a* mounted in an lamp-reflector assembly 8*a* of the present invention, the reflected output light beam 15*a* is contained within a total included cone angle of less than 80°. This is a preferred configuration for axial-filament xenon lamps because it enables the reflected output light beam 15*a* to be directed to areas which require improved illumination without causing excessive glare or eye irritation from reflected output light being directed at too wide a total included cone angle.

Figure 3:
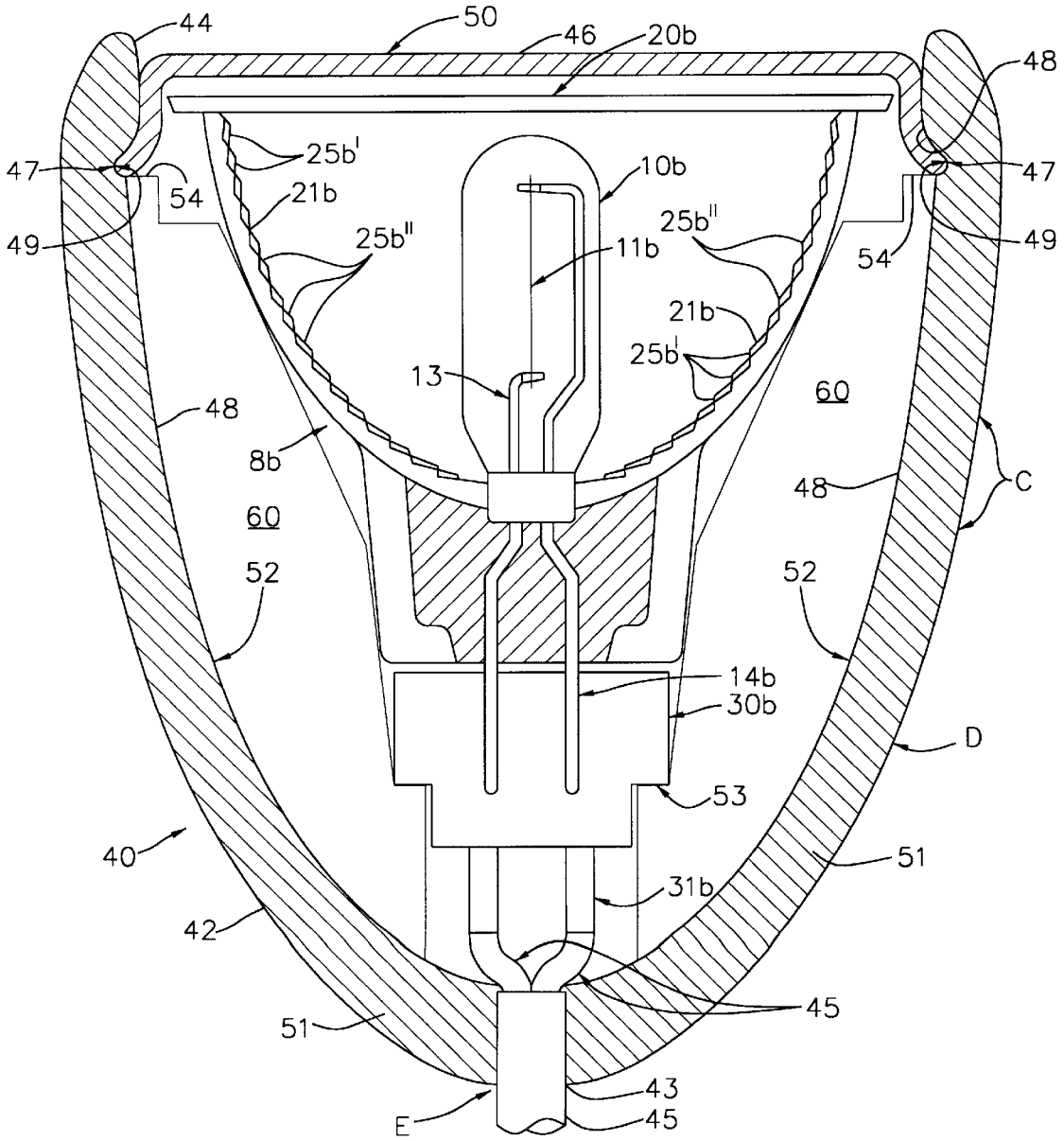
FIG. 3 is a semi-schematic sectional view of the xenon lamp-reflector assembly of FIGS. 2*a* and 2*b*, shown inside an embodiment of a flexible enclosure constructed according to the principles of the present invention.

Referring now to FIG. 3, an embodiment of a light assembly 40 constructed in accordance to the principles of the present invention is shown. In this embodiment, like features to those of previous embodiments are designated by like reference numerals, succeeded by the letter "b." As shown, a lamp-reflector 8*b* is housed within a surrounding enclosure 42. Preferably, the enclosure is constructed of a flexible waterproof material as will be described in detail below and surrounds one of the lamp-reflectors as described in the previous embodiments to form a waterproof light assembly. As illustrated, the lamp reflector incorporates a xenon lamp 10*b*.

The flexible enclosure 42 extends between a rear opening 43 and a front opening 44. The rear opening 43 is configured slightly smaller in size than the outside size or diameter of a power cord 45 which supplies power to the lamp 10*b*. This slight undersizing enables a waterproof seal to be formed around the cord 45. As illustrated, the power cord 45 has a circular outer diameter which passes through a circular rear opening 43 in the enclosure 42. The power cord 45 may be any multi-conductor cord as required by the lamp 10*b* or by any applicable application standards and requirements.

The front opening 44 is adapted to receive a translucent front lens 50. This translucent front lens 50 provides a protective shield to the lamp assembly 40 and also creates a watertight seal within the enclosure 42. The lens 50 allows the transmission of the light output beam and is sealably connected to the enclosure 42.

The translucent front lens 50 is preferably round and configured to fit within the front opening 44 which is also preferably round. The lens 50 may be configured with an outer lens surface 46 and a peripheral lip 47. The peripheral lip 47 is used to sealably contact against an inner wall 48 of the enclosure 42. Preferably, an internal groove 49 is formed within the inner wall 48 and configured to fit and to receive the peripheral lip 47. The inner groove 48 may be of a slightly smaller diameter than the outer diameter of the peripheral lip 47 to ensure an adequate seal. This configuration allows simple replacement or exchange of the lens by manipulating the flexible enclosure 42 to surround or to be removed from engagement with the peripheral lip 47.

The lens 50 may be made from essentially any type of plastic material which is translucent, including polycarbonate. The lens 50 may be tinted. Tinting allows the output beam to be provided in almost any color. Alternatively, by simply switching or combining the lenses 50, the color of the output light beam may be changed. This provides an option to fit the light assembly 40 with any variety of colored, diffusion patterned or other shaped lenses 50.

In a preferred embodiment of the present invention, the enclosure 42 is constructed from a relatively soft and flexible waterproof material. Preferably, the durometer rating of this material is between about 40 and 60. This durometer insures that the enclosure is sufficiently soft to provide an adequate watertight seal at the rear and front openings 43 and 44. The soft material also provides shock resistance.

When a xenon lamp 10*b* is utilized with the lamp-reflector assembly 8*b* of the present invention, a thermoplastic elastomer material may be used for the flexible enclosure 42 because some thermoplastic materials are capable of operating at the reduced temperature environment anticipated with xenon lamps. Using a thermoplastic elastomer lowers the manufacturing cost compared with the use of thermosetting materials which may alternatively be used for the flexible enclosure. The flexible enclosure 42 may be constructed using any method as known to those of skill in the art of making thin flexible enclosures, however, it may be preferred to construct the enclosure through injection molding.

When a tungsten halogen lamp is utilized, either silicone rubber or other similar thermosetting materials may preferably be used for the flexible enclosure 42 thereby enabling the flexible enclosure to withstand the high temperatures of the tungsten halogen lamp.

Unless the light assembly 40 is to be used underwater or in a continuously-cooled environment, and whenever a lamp with a wattage of greater than 10 watts is utilized in lamp-reflector assembly 8*b* of the MR-11 configuration, or whenever a lamp with a wattage of greater than 20 watts is utilized in a lamp-reflector assembly of the MR-16 configuration, then either silicone rubber, or other similar thermosetting materials may preferably be used to construct the flexible enclosure 42. As previously described, the enclosure 42 may be injection molded.

Preferably, the flexible enclosure 42 is constructed to form a continuous outer wall 52 of the flexible material which is configured to surround and house the lamp-reflector assembly 8*b*. In a preferred embodiment, the shape of the flexible enclosure 42 resembles a portion of an egg. For the MR-11 configured lamp-reflector, the enclosure 42 is about the size of a portion of a Grade AA chicken egg, with outside dimensions of less than about 2.0 inches in diameter and less than about 2.0 inches long. For the MR-16 configured lamp-reflector assembly, the outside dimensions of the egg-shaped flexible enclosure 42 are less than about 2.4 inches in diameter and less than about 2.4 inches long.

The flexible enclosure 42 is configured with an internal structure for supporting the lamp-reflector assembly 8*b*. As illustrated, the internal structure may also be configured with a socket guide 53 for supporting a socket connected to the power cord 45. This configuration supports the simple replacement of the lamp-reflector assembly 8*b*. The internal structure also supports the lamp-reflector assembly and spaces the hot lamp and reflector apart from the wall 48 of the enclosure 42. This spacing provides a layer of air reducing the conduction of heat from the lamp 10*b* and reflector assembly 86 to the wall 48. This advantageously keeps the temperature of the outer surface of the wall 42 cool.

Preferably, the internal structure comprises a plurality of fins 60 which extend radially inwardly from the wall 48 and which are symmetrically spaced around the inner circumference of the enclosure 42. The fins 60 are each configured with a landing or socket guide 53 to support the electrical socket 30*b* and a curved portion shaped to support the lamp-reflector assembly. In one embodiment of practice of the present invention, the fins 60 terminate at their upper ends in a second landing 54 for supporting the front lens 50. Alternatively, the second landing may be provided by internal structures other than the fins 60. In other embodiments, no second landing is provided. In the illustrated embodiment, proper location of the front lens 50 in the groove 49 is assured by the landing 54 which prevents the lens 50 from being pushed too far into the flexible enclosure 42. Preferably, the wall 51 and the internal fins 60 are each at least 3.0 mm thick, where the thickness of the fins is measured in a circumferential direction. Furthermore, it is preferred that there are at least three of the internal fins 60 spaced circumferentially around the inside surface of the enclosure 42.

An advantage of the present invention is that the enclosure is waterproof, yet the lamp-reflector assembly 8*b* is easily removed and replaced by hand. To change the lamp-reflector 8*b*, the front lens 50 is first removed by manipulating the enclosure 42 and "popping" the lens 50 out of the internal groove 49. The lamp-reflector assembly 8*b* may then be exchanged or replaced by removing the connection pins 14*b* from the socket 30*b*. By sliding the electrical power supply cord 45 through the rear opening 43 into the rear portion of the enclosure 42 (or alternatively most anywhere in the enclosure), the attached electrical socket 30*b*, if provided, may be pushed outside the flexible enclosure 42, thereby making it much easier to unplug the pins 14*b* from the socket 30*b*.

The lamp-reflector assembly 8*b* is replaced by inserting the pins 14*b* into the socket 30*b*. The entire assembly may then be re-installed into the flexible enclosure 42 by pulling the power supply cord 45 and by pushing the lamp-reflector assembly 8*b* until the socket 30*b* comes to a stop at landings 53 provided by the internal structure 52.

In one embodiment, the socket 30*b* is cemented into the enclosure 42 by use of an appropriate sealant. One such sealant is a silicone sealant identified as RTV silicone sealant-clear or RTV silicone sealant-red, sold by CRC Industries, Inc., of Warminster, Pennsylvania. The use of such a sealant provides a positive watertight seal between the cord and housing.

Figure 4:
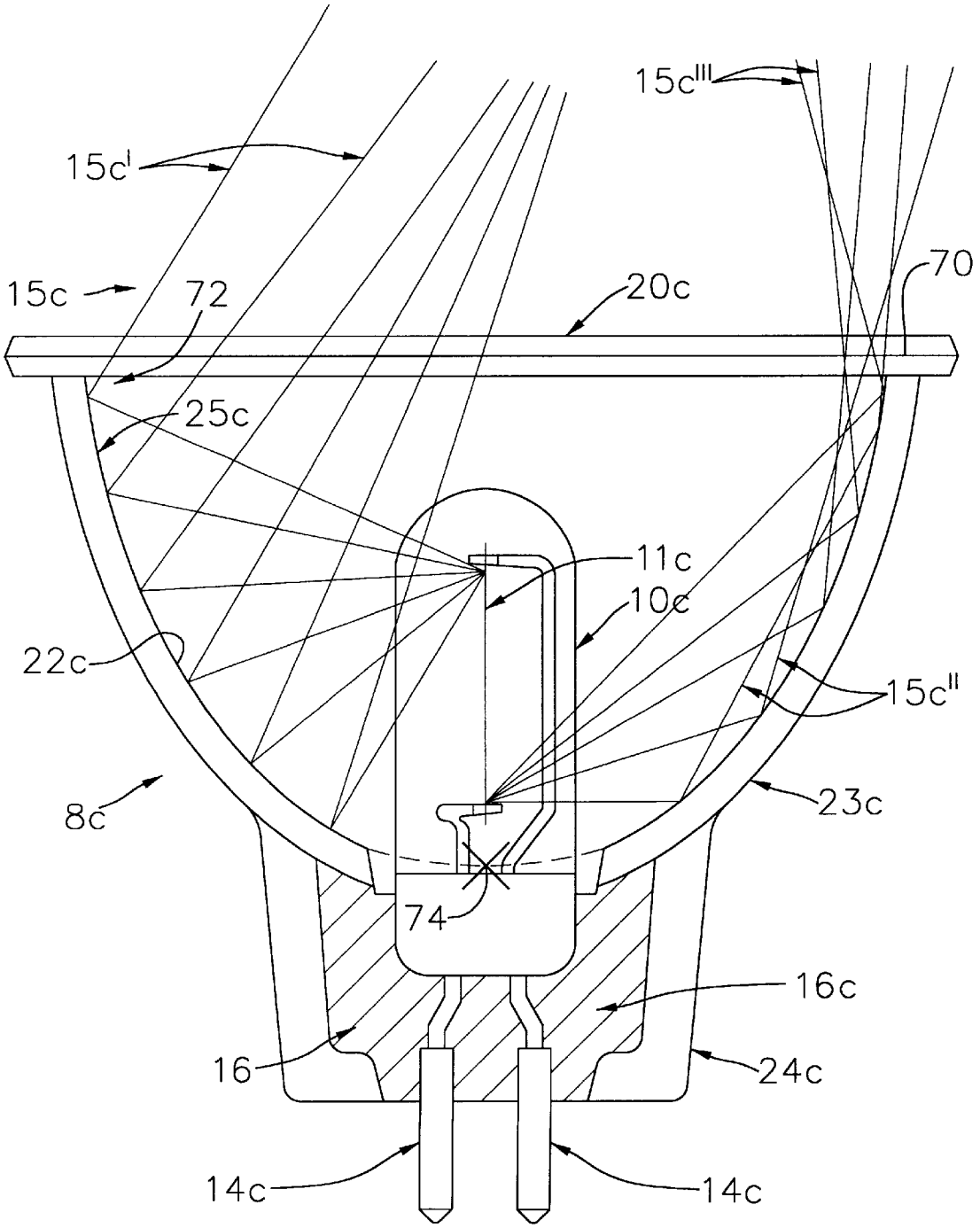
FIG. 4 is a semi-schematic sectional view of a lamp-reflector assembly constructed according to the principles of the present invention and incorporating an MR-16 configured reflector and a xenon lamp and showing light rays emanating from opposing ends of the axially-aligned filament.

Referring now to FIG. 4, an alternative embodiment of a light assembly according to the principles of the present invention is shown. In this embodiment, like features to those of previous embodiments are designated by like reference numerals succeeded by the letter "c." As illustrated, a lamp assembly 60 includes a lamp-reflector assembly 8*c* as previously described. The lamp assembly 8*c* is illustrated without a flexible enclosure as previously described to clarify the reflections of the light. However, this embodiment is understood to include a flexible enclosure as described in the previous embodiment.

In a preferred configuration of the illustrated embodiment, the lamp-reflector assembly 8*c* is configured as previously described for a xenon lamp 10*c*, but utilizing a reflector 23*c* having a configuration similar to a conventional MR-16 reflector. The xenon lamp 10*c* may be a 12 volt, 20 watt xenon lamp with an axial filament 11*c*, as desired. Light rays are illustrated which show such rays emanating from opposing ends of the axially aligned filament 11*c*.

The diameter of the illustrated MR-16 configured reflector 23*c* is preferably about 50 mm and the overall length is about 38 mm. The base 24*c* of the reflector 23*c* may be rectangular in cross-section and, preferably, are approximately 16 mm by about 11 mm. Two electrical connection pins 14*c* are provided and, in the MR-16 configuration, are preferably about 1.5 mm in diameter and are spaced on centers 5.3 or 6.3 mm apart. These pins 14*c* are preferably about 7.0 mm long. A ceramic cement 16*c* may be used to fix the xenon lamp 10*c* into a socket end of the reflector 23*c*. However, as previously mentioned for the reflector 23*a* in the MR-11 configuration, these dimensions are not required or absolute but may be modified for a particular application. Utilization of the MR-type reflector configuration increases the compatibility of the present light assembly due to their wide spread use and acceptance.

The reflected light rays from the upper portion of the xenon filament 11*c*, as illustrated, are reflected into an axial output light beam 15*c*' which crosses over an axial centerline through the lamp-reflector assembly 8*c*. There are also reflected light rays 15*c*" produced from a lower portion of the axially-aligned filament 11*c* at the smaller end of the MR-16-type reflector 23*c* which have double reflections. Most of the reflected light rays from the portion of the xenon filament at the smaller end of the reflector 23*c* are reflected into an output light beam having a smaller total included cone angle than the 15*c*' reflected light rays. The 15*c*' and 15*c*'" light rays are single reflections. The total included cone angle of the reflected light is less than about 60°.

Even though a standard MR-type reflector is used, in this embodiment, the total reflected output light beam 15*c* from the xenon lamp 10*a* mounted in MR-16 configured reflector 23*c* has a total included cone angle of less than about 80°. Despite the axial alignment of the xenon lamp filament 11*c*, the output light beam 15*c* from the xenon lamp-reflector assembly in an MR-16 configuration is substantially equivalent to the output light beam from a similar tungsten halogen lamp-reflector assembly in a similar MR-16 configuration reflector and light assembly. The reason that the included cone angle is less than about 80° is because of the relative dimensions of the bulb and reflector unit. For example, the relative dimensions of the light required for providing a cone angle of less than about 80° compared to the dimensions of the reflector are accurately depicted in FIG. 4. Thus, it is preferred that the top of the xenon filament 11*c* be no more than about two-thirds the distance to the top 70 of the reflector, where the ratio of the reflector diameter at its opening 72 to the height of the reflector measured from the apex 74 of the inside surface of the parabolic reflector (shown as a dashed line illustrating the extended surface of the parabola) to the top 70 is 1.67 or less. Having such a ratio of about 1.67 or less minimizes the amount of non-reflected light escaping from the reflector, thereby resulting in a cone angle of less than 80°.

Referring back to FIGS. 1–4, the light assembly of the present invention will now be described in general and without regard to a specific embodiment. This general description includes an important aspect of the present invention which minimizes the outer surface temperature of the flexible enclosure 40 including a tungsten halogen or xenon lamp-reflector assembly 8.

Tests were conducted using a K-type chromel-alumel thermocouple to measure the temperature of the various lamp-reflector configurations enclosed within the flexible enclosure as shown in FIG. 3. A first series of tests were conducted with a tungsten halogen lamp-reflector assembly in an MR-11 reflector configuration housed within a flexible enclosure and operating with a 12 volt, 10 watt tungsten halogen lamp. A second series of tests were then conducted with a xenon lamp-reflector assembly in a modified MR-11 reflector configuration housed within exactly the same type of flexible enclosure operating with a xenon lamp with the same 12 volt, 10 watt rating. Once steady state was reached, temperatures were measured as shown in the table below. The table compares the results for tungsten halogen and xenon lamps (12 volt, 10 watt) inside the respective lamp-reflector assemblies and flexible enclosures of the present invention.

| | Tungsten Halogen | Xenon | Xenon Improvement |
|---|---|---|---|
| At base of 10-watt lamp, per location A | 475° F. (FIG. 1) | 325° F. (FIG. 2a) | 150° F. cooler |
| Outside MR-11 reflector, per location B | 380° F. (FIG. 1) | 300° F. (FIG. 2a) | 80° F. cooler |
| Outside flexible enclosure, per FIG. 3, location C | 195° F. | 155° F. | 40° F. cooler |

-continued

| | Tungsten Halogen | Xenon | Xenon Improvement |
|---|---|---|---|
| Outside flexible enclosure, per FIG. 3, location D | 160° F. | 125° F. | 35° F. cooler |
| Outside flexible enclosure per FIG. 3, location E | 150° F. | 120° F. | 30° F. cooler |

A unique and surprising result was the dramatic reduction in outer surface temperature of the flexible enclosure 42 with the xenon lamp compared with the tungsten halogen lamp enclosed within exactly the same type of flexible enclosure, and operating at the same voltage and wattage. This is attributed to the lower temperature measured at the base of the xenon lamp, compared with the tungsten halogen lamp. It should be noted that due to a higher color temperature and higher operating efficiency, the reduced temperatures of the xenon lamp were also obtained with a greater intensity of visible output light, compared with the tungsten halogen lamp.

Many different configurations of the light assembly 40 of the present invention may be created using the principles of the present invention wherein a tungsten halogen or xenon lamp 10 is mounted in a reflector 23 having a dichroic-coated surface 21 and including a multi faceted reflective interior surface 22 to provide a directed output beam of optionally colored output light. As described, the light assembly 40 of the present invention includes a lamp-reflector assembly 8 housed within a flexible enclosure 42 having an easily exchangeable, circular translucent lens 50. The lens 50 forms a waterproof seal along the front opening 44 within the flexible enclosure 42. As also described, an electrical power supply cord 45 provides electrical power to the lamp 10 and forms a second waterproof seal at the rear opening 43 of the flexible enclosure 42.

In the illustrated embodiments, the waterproof lighting system 40 is about the size of a large chicken egg. The light assembly may use a 12 volt, 10 watt tungsten halogen lamp 10 in an unmodified MR-11 reflector assembly 23 within a watertight flexible enclosure 42. Alternatively, different lamps and reflector assemblies, including the modified MR-type reflectors of the present invention, may be used as well as different sized flexible housings. Power may be supplied by a conventional 120 volt magnetic transformer operating at 60 Hz through the power supply cord 45.

Alternatively, the light assembly 40 may also be constructed using a 12 volt, 10 watt xenon lamp 10 in a modified MR-11 reflector assembly 23 within a flexible enclosure 42. Power may be supplied by a high-frequency ballast-type 120 volt transformer operating at 20,000 Hz or more through the power supply cord 45.

Other alternative considerations are also contemplated, for example, the light assembly 40 of the present invention could be used in vehicles having low voltage electrical systems (or otherwise converted to low voltage), including automobiles, boats, trains, aircraft, police cars, emergency vehicles, military vehicles, trucks, trailers, etc. Light assemblies of the present invention may also be used alone or in combination to illuminate potted plants by shining the light upwards through leaves and foliage, thereby creating beautiful shadows on walls and ceiling at night while also providing an effective night light, while at the same time assisting the plant to grow more effectively because of the usefulness of the output light for plant growth and health. In this application, the potted plant can be watered normally because the lighting system of the present invention is waterproof.

Yet another example is for underwater uses, such as aquariums, fountains, or pools, where the output light in optional colors is particularly attractive at night. Myriads of additional examples include desk lamps, reading lamps, display lamps, and a variety of portable lamps for a variety of uses from improved illuminating systems for medical or dental uses, such as examinations or surgeries, to technicians requiring small lighting systems to work on intricate computer parts that may be locating within restricted spaces, or machinists and tool makers needing improved illumination near the cutting tool where lubricating fluids require a waterproof lighting system.

It will be understood that various modifications can be made to the disclosed embodiments of the present invention without departing from the spirit and scope thereof. For example, various sizes of the light assembly, including the lamp-reflector assembly are contemplated as well as various sizes of the facets and incorporated lamps. Various materials of construction are also contemplated for the reflector and housing assemblies as well as other components. Also, various modifications may be made to the configurations of the parts and their interaction. Therefore, the above description should not be construed as limiting the invention, but merely as an exemplification of preferred embodiments thereof. Those of skill in the art will envision other modifications within the scope and spirit of the present invention as defined by the appended claims.

We claim:

1. A waterproof light assembly for directing a beam of light comprising:

a lamp-reflector assembly containing an electrically powered lamp housed within a reflector;

a translucent lens; and a flexible enclosure extending between a front opening and a rear opening;

wherein the front opening in the flexible enclosure surrounds the lamp reflector assembly and at least a portion of the lens and the rear opening surrounds at least a portion of a power cord passing therethrough and interconnected with the lamp, the front and rear openings being adapted to form a seal about the lens and the power cord respectively.

2. The waterproof light assembly as recited in claim 1, wherein the enclosure is sufficiently flexible such that when submerged in water, compression along the front and rear openings enhances sealing around the lens and power cord.

3. The waterproof light assembly as recited in claim 2, wherein the flexible enclosure comprises a material having a durometer rating between about 40 and 60.

4. The waterproof light assembly as recited in claim 1, wherein the reflector comprises a dichroic-coated glass reflector having an interior surface formed with a plurality of reflective facets for reflecting light from the lamp into an output light beam having a total included cone angle of less than about 80°.

5. The waterproof light assembly as recited in claim 1, wherein the lamp is a tungsten halogen lamp.

6. The waterproof light assembly as recited in claim 1, wherein the lamp is a xenon lamp.

7. The waterproof light assembly as recited in claim 4, wherein the reflector comprises an MR-11 configuration.

8. The waterproof light assembly as recited in claim 1, wherein the reflector comprises an MR-16 configuration.

9. The waterproof light assembly as recited in claim 1, wherein the front opening in the flexible enclosure comprises an internal groove for sealing against a radial lip on the translucent lens.

10. The waterproof light assembly as recited in claim 1, wherein the flexible enclosure comprises a plurality of internal fins for guiding a rear end of the lamp-reflector assembly toward the rear opening in the flexible enclosure and for providing an insulating layer of air to reduce heat transfer from the lamp-reflector assembly to the outer surface of the flexible enclosure.

11. The waterproof light assembly as recited in claim 10, wherein the internal fins are shaped to form a socket guide for a base portion of the lamp reflector assembly and to facilitate changing said lamp-reflector assembly.

12. The waterproof light assembly as recited in claim 1, wherein the translucent lens can be changed to provide different contrasts and colors of the directed light.

13. The waterproof light assembly as recited in claim 1, wherein a sealant is used to provide a watertight connection between the flexible enclosure and the power cord.

14. A method of providing a waterproof housing for miniature lighting systems, wherein a tungsten halogen or xenon lamp fixed in a lamp-reflector assembly with dichroic-coated glass faceting provides a directed beam of output light, wherein said lamp-reflector assembly is housed within a flexible enclosure having an exchangeable, circular translucent lens forming a waterproof seal at the front of said flexible enclosure, wherein a round electrical power supply cord forms another waterproof seal at the rear of said flexible enclosure.

15. A method according to claim 14, wherein said tungsten halogen or xenon lamps are rated 12 volts and 10 watts, wherein the lamp-reflector assembly is connected via a small socket to a round electrical power supply cord, and wherein said flexible waterproof enclosure is less than 2.0 inches in diameter and less than 3.0 inches in overall length.

16. A method according to claim 14, wherein the lamp is rated between approximately 10 and 30 watts, wherein the lamp-reflector assembly is connected via a small socket to a round electrical power supply cord, wherein said flexible enclosure is between about 2.0 and 2.4 inches in diameter and between about 2.0 and 2.4 inches in overall length.

17. A light assembly directing a light beam comprising:

an electrically powered lamp having an axially-aligned filament;

a reflector housing the lamp and having an inside surface configured with at least 32 radial lanes of facets, each lane having at least 12 facets, at least 6 of said at least 12 facets being oriented in a direction generally facing the light beam emanating from the lamp and at least 6 of said at least 12 facets being oriented in a direction nearly parallel with the axis of the light beam emanating from the lamp;

a translucent lens; and a flexible enclosure extending between a front opening and a rear opening;

wherein the flexible enclosure houses the lamp and the reflector and surrounds a portion of the translucent lens.

18. The light assembly as recited in claim 17, wherein the reflector inside surface is coated with a layer of a dichroic material.

19. The light assembly as recited in claim 18, wherein the dichroic material is silver colored and reflective.

20. The light assembly as recited in claim 17, wherein the radial lanes comprise a first configuration and a second configuration, wherein the lanes of the first configuration alternate with the lanes of the second configuration, so as to provide the reflector with increased mechanical strength and more uniform average thickness of the glass material.

21. The light assembly as recited in claim 17, wherein the flexible enclosure comprises an external wall and an internal wall and wherein the internal wall is spaced apart from at least a portion of the reflector to reduce the amount of heat transferred into the external wall.

22. A light assembly directing a light beam comprising:

an electrically powered lamp having an axially aligned filament; and a glass reflector housing the lamp and having a generally parabolic shape with an inside reflective surface configured with a multiple number of facets arranged in radial lanes;

wherein a plurality of radial lanes of a first type are between a plurality of radial lanes of a second type so as to provide the reflector with increased mechanical strength and more uniform average thickness of the glass material;

wherein the light from the reflector is focused by said facets to provide an output light beam having a total included cone angle of less than 60°.

23. The light assembly as recited in claim 22, wherein each of said first and second types of radial lanes of facets comprise at least 16 such lanes, each lane having at least 8 facets, wherein at least 4 of the facets comprise nearly axial risers along the reflective surface between 80° and 90° and at least 4 facets have radially-oriented treads at angles between 16° and 50°.

24. A light assembly for directing a light beam comprising:

an electrically powered lamp having an axially aligned filament, wherein the filament has a bottom closest to the base of the lamp and a top distant from the base;

a reflector assembly, housing the lamp and having an inside surface configured with a multiple number of facets, the reflector having a top at the reflector opening and an apex, wherein the top of the filament is no more than about two-thirds the distance from the apex to the top of the reflector and the ratio of the reflector diameter at its opening to the height of the reflector measured from the reflector apex to the top is 1.67 or less, wherein the light from the reflector is focused by said facets to provide an output light beam having a total included cone angle of less than about 80°.

25. A light assembly for directing a light beam comprising:

an electrically powered lamp having an axially aligned filament, wherein the filament has a bottom closest to the base of the lamp and a top distant from the base;

a reflector assembly housing the lamp and having a generally parabolic shape with an inside reflective surface configured with a multiple number of facets arranged in radial lanes;

wherein each of said radial lanes of facets comprise at least 8 facets, wherein at least 4 facets comprise nearly axial risers along the reflective surface between 80° and 90° and are interspersed between at least 4 facets have radially-oriented treads at angles between 16° and 50°;

wherein the top of the reflector is near the top of the lamp and the apex of the reflector is near the base of the lamp;

wherein the top of the filament is no more than about two-thirds the distance from the apex to the top of the reflector, and the ratio of the reflector diameter at its opening to the height of the reflector measured from the apex to the top is 1.67 or less; and wherein light from the reflector is focused by said facets to provide an output light beam having a total included cone angle of less than 60°.

* * * * *

UNITED STATES PATENT AND TRADEMARK OFFICE

CERTIFICATE OF CORRECTION

PATENT NO. : 6,053,623
DATED : April 25, 2000
INVENTOR(S) : Dale G. Jones; Barbara L. Marcum It is certified that error appears in the above-identified patent and that said Letters Patent is hereby corrected as shown below:

Column 18,
Line 54, replace "less than about 80°." with -- less that 80°. --.

Column 19,
Line 1, replace "at least 4 facets have" with -- at least 4 facets having --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*